US005664443A

United States Patent [19]

Abbenhaus

[11] Patent Number: 5,664,443

[45] Date of Patent: Sep. 9, 1997

[54] MACHINE FOR PRETREATMENT, DYEING AND/OR AFTERTREATMENT

[75] Inventor: Willi Abbenhaus, Coesfeld, Germany

[73] Assignee: Thies GmbH & Co., Coesfeld, Germany

[21] Appl. No.: 518,462

[22] Filed: Aug. 23, 1995

[30] Foreign Application Priority Data

Nov. 11, 1994 [DE] Germany ..... 44 40 336.4

[51] Int. Cl.[6] ..... D06B 23/20

[52] U.S. Cl. ..... 68/18 F

[58] Field of Search ..... 68/18 F, 158, 68/177, 178

[56] References Cited

U.S. PATENT DOCUMENTS 3,013,422 12/1961 Amidon, Jr. et al. ..... 68/18 F
5,431,031 7/1995 Vinas ..... 68/18 F X

FOREIGN PATENT DOCUMENTS 2812221 9/1979 Germany ..... 68/18 F
1747566 7/1992 U.S.S.R. ..... 68/18 F

*Primary Examiner*—Philip R. Coe
*Attorney, Agent, or Firm*—Meltzer, Lippe, Goldstein, et al.

[57] ABSTRACT

A machine is described for the pretreatment, dyeing and/or aftertreatment of textile goods, with an autoclave for reception of the textile goods and a treatment liquor, a circulating system for the liquor equipped with at least one transport pump for the liquor and a filter system through which the treatment liquor flows, whereby the filter system is situated within the autoclave.

23 Claims, 2 Drawing Sheets

MACHINE FOR PRETREATMENT, DYEING AND/OR AFTERTREATMENT

BACKGROUND OF THE INVENTION

The present invention relates to a machine for the pretreatment, dyeing and/or aftertreatment of textile goods.

Many forms of machines are known for the pretreatment, dyeing and/or aftertreatment of textile goods, that, in particular, take the form of yarn bobbin, fabric run roll or fabric rope. These machines are usually referred to in the specialist technological language as dyeing machines, in which the textile goods, which are processed in batches, are not usually only dyed but also pretreated or aftertreated. For this purpose an amount of the textile goods chosen on the basis of the particular machine size is placed in the autoclave of the particular machine whereby the autoclave is associated with at least one circulating system for the particular treatment liquor.

Furthermore, in textile practice machines are known that treat a run of textile fabric in the open-width state, particularly washing, bleaching and rinsing. Such machines are usually referred to as open-width treatment machines since the run of fabric is treated with the particular liquor in the spread-out state.

On account of the fact that the stream of the treatment liquor through and against the textile goods causes fluff, thread debris, thread dust or other insoluble particles and/or fragments, which hereinafter will be referred to collectively as foreign particles, to be removed and, thus, end in the treatment liquor, it is necessary during the treatment to pass the liquor through a suitable filter system so that these aforementioned and insoluble foreign particles in the treatment liquor are filtered out of the treatment liquor in this manner so that undesired soiling of the textile goods to be treated or stoppage of pipe systems, particularly of spray tubes, is avoided.

The known machines, in particular the known cross-wound package dyeing machines, beam dyeing machines, rope dyeing machines, jet dyeing machines and/or open-width treatment machines are characterized by a filter system that is situated outside the particular machine or the particular box (department) of the open-width treatment machine attached to the suction or supply side of the transport pump or circulating pump so that as the treatment liquor is transported by the transport or circulating pump the whole treatment liquor is passed through the filter system. However, such an arrangement takes up a relatively large amount of space in the known machines.

The aim of the present invention is to make available a machine for pretreatment, dyeing and/or aftertreatment of textile goods of the aforementioned type, which is characterized by a particularly compact mode of construction.

SUMMARY OF THE INVENTION

This aim is solved out according to the invention by a machine possessing the characteristic features of the present invention. The present invention is a machine for pretreatment, dyeing and/or aftertreatment of textile goods comprising an autoclave for receiving the textile goods and a treatment liquor. The treatment liquor is circulated throughout the autoclave by a circulating system having at least one transport pump and one filter system through which the treatment liquor passes. The filter system is equipped with at least one overflow device located in the stream of flow of the treatment liquor. The overflow device is equipped with at least one overflow pipe having a funnel with an adjustable aperture. The adjustable aperture is used to adjust the volume of treatment liquor to be filtered.

The machine according to the invention which, like the aforementioned machines for pretreatment, dyeing and/or aftertreatment of textile goods in the most various forms, in particular as yarn bobbins, fabric rolls, fabric beam rolls and in the open-width state and preferably in the form of a fabric rope, possesses an autoclave, in particular a high temperature autoclave, to take up the textile goods and a suitable treatment liquor. In this connection the autoclave is equipped with a circulating system provided with at least one transport pump for the liquor, whereby the treatment liquor flows through a filter system during the treatment so that said foreign particles sticking to the textile goods (fluff, thread debris, insoluble components, textile goods dust etc.), that are transferred to the treatment liquor during treatment, are separated out from the treatment liquor. In the machine according to the invention the filter system is situated within the autoclave.

The term autoclave employed in this application also covers such housings that are classically referred to as boxes (or departments) in open-width treatment machines.

The machine according to the invention exhibits a range of advantages. Because of the fact that the filter system, that is externally associated with the known machines, requires a relatively large amount of space, it is located within the autoclave in the machine according to the invention, the machine according to the invention possesses a very compact constructional form, so that it also takes up a relatively small amount of floor space. Furthermore, the machine according to the invention can be very rapidly and simply erected, since it is not necessary here to connect the necessary filter system with the autoclave and circulating system by additional piping since in the machine according to the invention this filter system is integrated into the autoclave. This again has the advantage that the machine according to the invention is relatively easily and rapidly moved about within an existing plant. The energy losses are also limited for the machine according to the invention because the liquor does not leave the machine for the removal of the aforementioned foreign particles by the filter system so that the piping system necessary for this purpose, which would lead to an undesired cooling of the treatment liquor, is absent. This again has the effect that the temperature constancy of the treatment liquor is more easily maintained in the machine according to the invention, than it is for the known machines, so that accordingly the treatment of the textile goods carried out in the machine according to the invention is carried out in a particularly reproducible manner.

In one embodiment of the machine according to the invention the filter is so designed and installed within the autoclave such that 5% by volume to 50% by volume of the treatment liquor circulated per unit time is passed through the filter system. Surprisingly it was found here that even when only a part of the circulated treatment liquor was passed through the filter system the textile goods treated in the machine according to the invention are completely free from the aforementioned foreign particles, which also applies when, in particular, only 10% by volume to 30% by volume of the circulated treatment liquor per unit time is passed through the filter system situated within the autoclave. Even with articles producing large quantities of fluff (lint fly), such as, for example, towelling (terry cloth) or velour articles, there was no undesired soiling of the textile goods treated after appropriate treatment with the machine according to the invention when only 5% by volume to 50% by volume, in particular 10% by volume to 30% by volume, of the circulated treatment liquor per unit time was passed through the filter system. Depending on the transport capacity of the transport pump of the circulating system and the size of the particular machine the aforementioned percentages laid down mean that the amount of treatment liquor that is passed through the filter system installed within the machine according to the invention will be ca. 5 l/min to 50 l/min in the case of a pilot-scale machine with a capacity of ca. 10 to 20 kg textile goods, between 50 l/min to 500 l/min in the case of a production machine with a capacity of between 100 kg and 200 kg textile goods and between 100 l/min to ca. 2 000 l/min in the case of a production machine with a capacity of between ca. 200 kg textile goods to ca. 400 kg textile goods.

In order to ensure in the machine according to the invention that the removal of the aforementioned foreign particles from the treatment liquor or from a part of the treatment liquor is taking place properly, it is appropriate here to arrange the filter system or to position the filter system within the machine in such a manner that the treatment liquor flows through the filter system at constant pressure. This can be arranged, for example, by setting the filter system on the floor of the autoclave at a place where the treatment liquor collects after its contact with the textile goods or at which a part of the treatment liquor collects after its contact with the textile goods so that the treatment liquor or a part of the treatment liquor is forced to flow through the filter system on account of the positioning of the filter system. Generally, under these conditions, the constant pressure of the treatment liquor before the filter system lies within the range 0.005 bar to 0.1 bar.

A further embodiment of the machine according to the invention provides that the filter system is installed in a bypass to the circulating system installed within the autoclave. In this case a partial stream of the treatment liquor, particularly downstream of the transport pump forming part of the circulating system, i.e. on the delivery side of the transport pump, is branched off and forced to flow through the filter system, so that this partial stream of treatment liquor is correspondingly filtered and then returned to the suction side as a filtered partial stream of treatment liquor.

A further form of the aforementioned variant of the machine according to the invention provides that at least one overflow device is installed within the autoclave before the filter system in the direction of flow of the treatment liquor to be filtered. In this manner it is ensured that, on the one hand, the filter system is always fed with a constant pressure of treatment liquor, in particular as a result of the force of gravity, through which the volume flow per unit time of treatment liquor to be filtered is simply and constantly controlled and, on the other hand, the choice of the size of the overflow device allows a particularly regular proportion of treatment liquor, in particular the aforementioned volume of partial stream (between 5% by volume to 50% by volume, in particular between 10% by volume and 30% by volume of the circulated treatment liquor per unit time), is directed to the filter system.

Of course, it is also possible in the machine according to the invention to include an overflow device within the autoclave that is supplied with liquor not by a bypass in the recirculating system but, for example, by a separate pump.

The overflow device in the machine according to the invention can be realized in a particularly simple and effective manner if it takes the form of an overflow funnel. The funnel edge of the overflow funnel is then fitted with at least one overflow pipe whilst the overflow pipe ensures that a constant level of treatment liquor, that is to be filtered, is always maintained automatically in the overflow funnel. If the funnel outflow is also fitted with an aperture, in particular with an aperture that can be adjusted at will, such a realization of the machine according to the invention allows, in a particularly simple manner, the flow-through volume of the treatment liquor to be filtered, or of the partial stream of treatment liquor to be filtered to be adjusted in a particularly suitable manner to suit the particular circumstances and in particular the foreign particle content of the particular textile goods to be treated.

In order to ensure in the machine according to the invention that the total surface of at least one filter with which the filter system is equipped is evenly supplied with the treatment liquor that is to be filtered, a further variant in the construction of the machine according to the invention is equipped within the autoclave with a distribution device before the filter system, when viewed from the direction of stream of the treatment liquor that is to be filtered.

In particular, if this distribution device has a region for smoothing the stream of the treatment liquor to be filtered it is ensured that the total surface of at least one filter of the filter system located in the autoclave is always evenly supplied with the treatment liquor that is to be filtered.

In particular the machine according to the invention is equipped with a distribution device where the region for smoothing the stream of the treatment liquor to be filtered takes the form of a box-shaped region, whilst the box-shaped region extends over the whole length of the filter. Alone the shaping of the smoothing region as a box-shaped region brings about a smoothing of the stream of the treatment liquor to be filtered, which further means that the whole surface of the filter is evenly supplied with the treatment liquor to be filtered or with the partial treatment liquor to be filtered.

In particular when there are high flow velocities of the treatment liquor immediately before the minimum of one filter of the filter system, it is advisable to install liquor-deflecting and liquor-guiding elements within the box-shaped region, particularly in the neighbourhood of the supply pipe for the treatment liquor to be filtered; in particular, these elements prevent the entering liquor stream impinging directly on the supply opening leading to the filter surfaces. Here these liquor-deflecting and liquor-guiding elements are preferably formed from appropriately shaped sheet metal.

As already described above the distribution device for the treatment liquor to be filtered or for the partial treatment liquor to be filtered is preferably equipped at the bottom with a supply pipe for the treatment liquor to be filtered. In particular, then, if the distribution device is also equipped, at the top and, hence, at the opposite end to the supply pipe, with a supply opening over the whole length of the filter for the treatment liquor to be filtered this ensures that the whole surface of at least one filter equipping the filter system for the filtration of the treatment liquor or the partial treatment liquor stream is used. This ensures further that a local stoppage of the filter during a treatment operation is excluded.

In order to achieve the aforementioned even distribution of the treatment liquor over the whole surface of the filter it is particularly applicable to construct the supply opening of the distribution device in the form of an overflow weir whereby at least one filter of the filter system is then arranged below the overflow weir. In this manner the filter surface or filter surfaces is or are evenly supplied with the treatment liquor to be filtered, whilst the treatment liquor to be filtered then passes preferably, under the force of gravity, through the filter or filters.

With respect to the number of filters included in the machine according to the invention it should be noted that depending on the size of the filter and the capacity of the machine the filter system includes at least one filter and preferably at least two to fourteen filters This is particularly suitable when the aforementioned filters of the filter system are plate-shaped filters and these are installed in pairs with the filters of each pair arranged in a V-shaped configuration and below the aforementioned supply opening of the distribution device.

In particular then, when the V-shaped configuration of the plate-shaped filter of each filter pair is arranged at an angle α or ' of between 45° and 80°, preferably at an angle or ' of between 55° and 65° and especially at an angle α or 'α of 60° relative to the horizontal, it is ensured that the treatment liquor to be filtered will be supplied in particularly regular distribution to the whole filter surface by means of the distribution device assigned to each plate-shaped filter and positioned above the plate-shaped filter and that the liquor will then pass through the filter under the influence of gravity, thus bringing about the desired removal of foreign particles (fluff, thread debris, insoluble components etc.).

In the aforementioned embodiment of the machine according to the invention, which is equipped with at least one pair of filter plates arranged in a V-shaped configuration with respect to each other, in order to prevent the treatment liquor to be filtered or the partial treatment liquor to be filtered, that is supplied via the supply opening situated above each plate-shaped filter and the distribution device whose supply opening, at least, is above the filter, from running unfiltered over the side surface of the plate filter a further embodiment of the machine according to the invention provides that each filter plate is equipped with a limiting element at each side for the treatment liquor to be filtered, whereby this side limiting element, that is, in particular, composed of metal sheet, is chosen either to cover the whole length of the filter plate or preferentially only part of the whole length.

In the machine according to the invention in order to be able to catch and, in particular, to collect and remove from the autoclave the foreign particles that have been filtered out of the treatment liquor or out of the partial stream of the treatment liquor a further embodiment of the machine according to the invention provides that the bottom ends of the plate-shaped filters are fitted with a collection trough to collect and/or remove the foreign particles filtered off. Here the surface of the filter can be freed from the collected foreign particles either mechanically by means of a suitable scraper, or hydraulically or pneumatically using treatment liquor, fresh water and/or air, so that these foreign particles can be removed during or particularly at the end of a treatment cycle preferably by a rapid access port provided in the autoclave or via a drain opening associated with the collection trough, so that a cleaned filter is available in the machine for further treatment that is to follow.

In particular the machine according to the invention consists of a machine which makes possible the treatment of textile goods in the form of an endless rope or in the open-width state. This includes preferably all machines known and generally referred to as dyeing machines, whilst it is naturally possible to use these machines to wash, shrink, bulk, dye and/or to aftertreat textile fabrics in rope form. Furthermore, the machines according to the invention also include open-width treatment machines, in particular open-width washing machines or open-width bleaching machines where, in the case of these machines each box preferably equipped as an autoclave is equipped with the aforementioned filter system that is installed within the box (department) concerned.

Preferably, however, the machine according to the invention is such a machine that is characterized by a basically cylindrical autoclave, with this autoclave containing at least one rotatable drum for the uptake and transport of the goods in rope form, an orifice for treatment and transport of the goods in rope form and, if necessary, a reel, whilst this reel is arranged in the transport direction of the run of the fabric before the orifice. In this machine, which is also obtainable commercially under the name "roto-stream" (manufacturer Thies company), the drum is then provided with a central gap to accommodate the filter system arranged within the autoclave. The machine according to the invention can naturally also exhibit another form of construction, in particular a form of construction as is known and distributed to textile specialists under the names "eco-soft", "soft-stream", soft TRD", ring-soft", micro-, mini- and midi-soft", "eco-bloc" (manufacturer Thies company).

The machine according to the invention will be further explained on the basis of an example in conjunction with the drawing. Which shows:

FIG. 1 a schematic central longitudinal section through the machine;

FIG. 2 an enlarged, schematic cross section through the filter system arranged in the central interior of the machine.

In FIGS. 1 and 2 the same parts are designed with the same numbers.

DETAILED DESCRIPTION OF THE INVENTION

Figure 1:
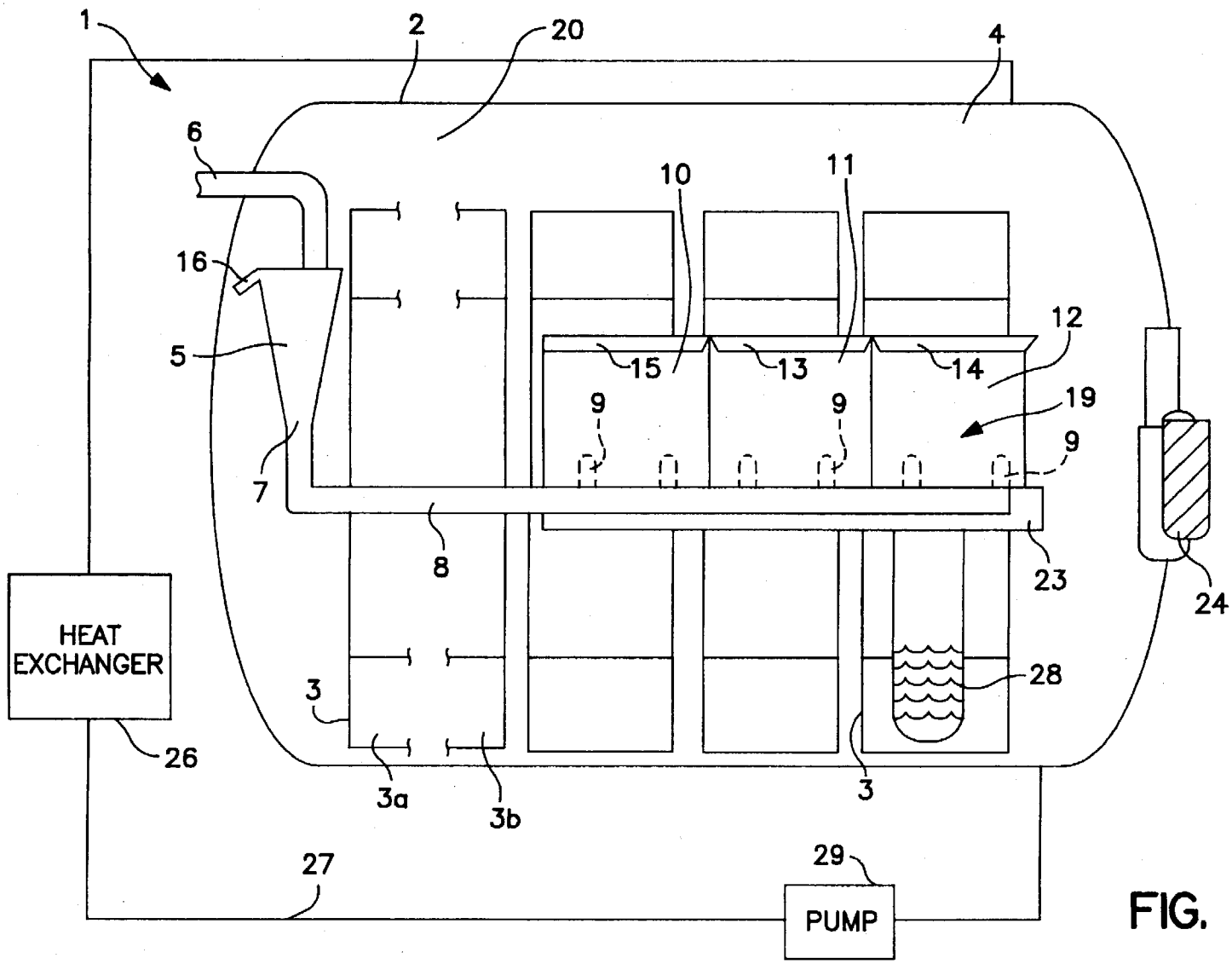

The machine shown schematically in FIG. 1 and designated with 1 comprises an autoclave 2, whereby four rotatable drums 3 are arranged inside the cylindrical autoclave 2. Each cylindrical drum 3 consists of two drum halves 3*a* and 3*b* arranged at a distance from each other, as is shown, as an example, just for the first drum on the left. Above each drum in region 20 there is an orifice which is not shown and a reel which is also not shown, whereby the orifice and the reel are used to transport the endless rope of fabric 28 arranged in each drum.

Outside the autoclave 2 a circulating system 27 is arranged that comprises at least one transport pump 29 a heat exchanger 26 and appropriate mixing vessels. Such a machine 1, with the exception of the filter system described in detail below, has long been known and is also in use for production, whereby this machine 1 is manufactured and distributed by the Thies company as "roto-stream" and for the rest is described in detail in German patent P 24 27 415.

Deviating from this known "roto-stream" machine the machine 1 illustrated in FIG. 1 exhibits a complete filtration system labeled 19. In this connection this filter system 19 is arranged in the radial center of the autoclave 2, in such a manner that it occupies the space formed by drum 3 on account of its cylindrical gap.

Filter system 19 comprises an overflow funnel 5 constructed as an overflow device. This overflow funnel 5 is supplied with a partial stream of the treatment liquor via a bypass pipe 6, which leads to the supply side of the transport pump of the circulating system of machine 1 which is not illustrated. The upper edge of the overflow funnel 5 is fitted with an overflow pipe 16 which is open to the body of the autoclave 2. By this means it is arranged that a constant level of liquor is always maintained in the overflow funnel 5 since the treatment liquor supplied via the bypass pipe 6 is drained off into the body of the autoclave 2 by means of pipe 16 when the overflow funnel has been filled to the pre-set level.

The funnel exit of the overflow funnel 5 is provided with a preferably adjustable aperture 7 with which the amount of the treatment liquor (partial stream) supplied to the filter system is held constant and preferably adjustable. Two pipes 8 and 8*a* lead from the overflow funnel, of which only the pipe 8 is shown in FIG. 1 while both pipes 8 and 8*a* are shown in FIG. 2, to filters 10, 11 and 12.

Figure 2:
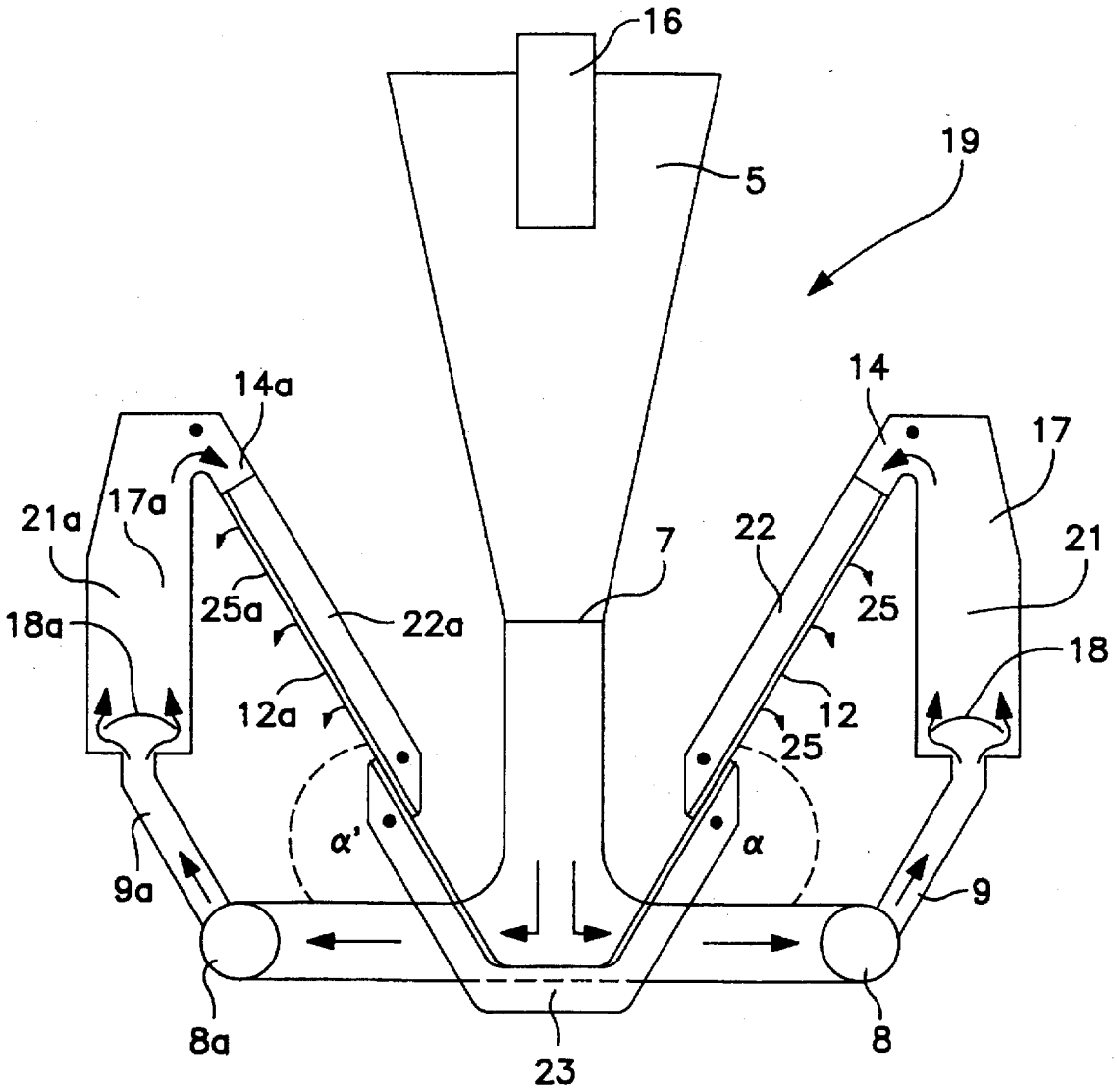

Whilst in machine 1 filters 10 to 12 have filters positioned opposite them which are not visible in FIG. 1 on account of the section chosen so that the discussion that follows now refers to FIG. 2 which reproduces in enlarged detail a cross section of filter 12 and 12*a*.

As can be seen from FIG. 2, using filter 12 and 12*a* as examples, filter 12 and 12*a* are arranged in V-shaped configuration with respect to each other in pairs, with the angles and ' possessing a value of 60°.

As seen from the direction of flow of the treatment liquor to be filtered, which is indicated with arrows in FIG. 2, the liquor to be filtered passes from the overflow funnel 5 and the already described pipes 8 and 8*a* via connection pipes 9 and 9*a* to distribution devices 17 and 17*a*.

Each distribution device 17 and 17*a* exhibits a box-shaped region 21 and 21*a* whilst each box-shaped region 21 and 21*a* is provided with a liquor-diverting sheet 18 and 18*a*. This arrangement ensures that the stream of treatment liquor to be filtered is smoothed by the liquor-diverting sheet 18 and 18*a* and the box shape of the region 21 and 21*a* whilst the distribution device 17 and 17*a* is adapted in its axial length to the axial length of the associated filter 12 and 12*a*.

In the upper region of the distribution device 17 and 17*a* there is a slit-shaped liquor supply opening 14 and 14*a* (FIG. 2) and 15, 13 and 14 (FIG. 1), where all slit-shaped supply openings 14 and 14*a*, or 15 and 13 extend over the axial length of the associated filters 12 and 12*a* or 10 and 11 (FIG. 1) and take the form of overflow weirs. This leads to the stream of the treatment liquor to be filtered being evenly directed over the surface of the associated filters 12 and 12*a* or 10 and 11 (FIG. 1).

In order to avoid undesired overflow of the liquor to be filtered at the side, each side edge of the plate-shaped filter 12 or 12*a* is equipped with a limiting element 22 and 22*a* as shown in FIG. 2.

The foot of the filter 12 and 12*a* is provided with a collection trough 23 which serves to collect the foreign particles (fluff, thread debris, insoluble dirt particles) filtered off by the plate-shaped filters.

In order to remove these particles from the autoclave 2, autoclave 2 is provided on the axial height of the collection trough 23 with a rapid access port 24 which can easily be opened when machine 1 is not in operation in order to remove the fluff accumulation in collection trough 23 manually from the machine with an appropriate scraper via the rapid access port 24. This rapid access port 24 is only illustrated in FIG. 1. Naturally there is also the possibility of providing the collection trough 23 with a drain opening into the atmosphere so that the adherent fluff can be removed from the autoclave mechanically or by means of liquor or compressed air.

The machine described on the basis of FIGS. 1 and 2 operates as described below:

A partial stream of the treatment liquor, preferably ca. 10% by volume, is directed via the bypass pipe 6 from the delivery side of the transport pump 29 of the not illustrated circulating system 27 to the overflow funnel 5, whereby the overflow funnel 5 maintains a constant level of liquor since the excess treatment liquor supplied runs unfiltered via pipe 16 into the body of the autoclave 2. Then the partial stream of the liquor to be filtered, whose volume stream is adjustable by aperture 7, is led evenly via pipe 8 and 8*a* and pipe 9 and 9*a* to the distribution device 17 and 17*a* arranged for each filter, whilst inside each distribution device 17 and 17*a* the liquor stream is smoothed to such an extent by the box-shaped region 21 and 21*a* and the deflecting sheet 18 and 18*a* that via the supply opening 14 and 14*a* (FIG. 2) or 13, 14 and 15 (FIG. 1) each filter 12 and 12*a* or 10, 11 (FIG. 1) is supplied with a constant and even stream of liquor to be filtered.

On account of the sloping arrangement of the plate-shaped filter 12 and 12*a* the liquor supplied to the top flows downwards as a thin film of liquor on the particular plate-shaped filter and penetrates this, as illustrated as an example by arrow 25 and 25*a* in FIG. 2. This effects the removal of foreign particles contained in the liquor so that these foreign particles collect initially on the surface of the sloping, plate-shaped filter or mainly, as a result of the sloping arrangement of the plate-shaped filter, slide down into the collection trough 23 or are flushed there by the liquor that follows so that the plate-shaped filters 12 and 12*a* (FIG. 2) or 13 to 15 (FIG. 1) are largely continually freed automatically from the foreign particles retained at their surfaces.

When each treatment in the autoclave is complete the foreign particles, which have mainly collected in the collection trough, are removed either mechanically via the rapid access port 24 or mechanically by means of liquor or of air via a drain opening that is not illustrated.

I claim:

1. A machine for pretreatment, dyeing and/or aftertreatment of textile goods comprising an autoclave for receiving said textile goods and a treatment liquor, a circulating system having at least one transport pump and a filter system through which said treatment liquor flows, said filter system having at least one overflow device fitted within said autoclave located in the stream of flow of said treatment liquor, said overflow device having an overflow funnel with at least one overflow pipe attached to said funnel, and said funnel having an adjustable aperture to adjust the volume of the treatment liquor volume to be filtered.

2. The machine according to claim 1 whereby 5% by volume to 50% by volume of the said treatment liquor being circulated per unit time is passed through the filter system.

3. The machine according to claim 1, whereby 10% by volume to 30% by volume of the treatment liquor being circulated per unit time is passed through the filter system.

4. The machine according to claim 1, whereby said treatment liquor is fed to said filter system under constant pressure.

5. The machine according to claim 1, whereby said filter system is installed in a bypass to said circulating system.

6. The machine according to claim 5, whereby the bypass is installed on the delivery side of said transport pump.

7. The machine according to claim 1, whereby a distribution device having a top and a base is installed within the autoclave before the filter system as seen from the direction of the stream of flow of the treatment liquor to be filtered.

8. The machine according to claim 7, whereby the distribution device possesses a region for smoothing the stream of the treatment liquor to be filtered within the distribution device.

9. The machine according to claim 8, whereby said region has the form of a box-shaped region, whereby the box-shaped region extends over the whole length of the filter.

10. The machine according to claim 9, whereby liquor-deflecting and liquor-guiding elements are fitted inside said box-shaped region.

11. The machine according to claim 8, whereby the base of the distribution device is equipped with a supply pipe for said treatment liquor to be filtered.

12. The machine according to claim 11, whereby the top of the distribution device is equipped with a supply opening extending over the whole length of the filter for said treatment liquor that is to be filtered.

13. The machine according to claim 12, whereby the supply opening is designed in the form of an overflow weir.

14. The machine according to claim 1, whereby the filter system contains at least one filter.

15. The machine according to claim 14, whereby said at least one filter includes plate-shaped filters installed in pairs and whereby the filters of each filter pair are arranged in a V-shaped configuration and below a supply opening of a distribution device installed within the autoclave before the filter system.

16. The machine according to claim 15, whereby said at least one filter has side edges and is equipped along each side edge with a boundary element for the liquor.

17. The machine according to claim 14, whereby said at least one filter is arranged at an angle $\alpha$ or ' of between 45° and 80°, preferably at an angle $\alpha$ or $\alpha'$ of between 55° and 65° relative to the horizontal.

18. The machine according to claim 14, whereby said at least one filter is equipped with a distribution device installed within the autoclave before the filter system.

19. The machine according to claim 14 wherein the filter system contains between two and fourteen filters.

20. The machine according to claim 1, whereby the filter system is equipped with a collection trough for collecting and/or leading off the particles which are filtered off.

21. The machine according to claim 1, whereby the machine is a rope-treating machine.

22. The machine according to claim 21, whereby the rope-treating machine is equipped in the autoclave with at least one rotatable cylindrical drum for uptake and transport of the textile rope whereby the drum has a central gap for the installation of said filter system.

23. The machine according to claim 1, whereby said machine is a full-width washing machine or a full-width bleaching machine having a plurality of autoclaves in accordance with claim 1, and each of said autoclaves is constructed as a box having a filter system associated with it.

* * * * *